US007207501B2

(12) United States Patent
Hanratty

(10) Patent No.: US 7,207,501 B2
(45) Date of Patent: Apr. 24, 2007

(54) SYSTEMS AND METHODS FOR GENERATING HIGH VOLUMES OF FOAM

(75) Inventor: Michael P. Hanratty, Yaphank, NY (US)

(73) Assignee: Hanratty Associates, LLC, Shirley, NY (US)

( * ) Notice: Subject to any disclaimer, the term of this patent is extended or adjusted under 35 U.S.C. 154(b) by 126 days.

(21) Appl. No.: 10/603,272

(22) Filed: Jun. 25, 2003

(65) Prior Publication Data

US 2004/0123991 A1 Jul. 1, 2004

Related U.S. Application Data

(63) Continuation-in-part of application No. 10/315,314, filed on Dec. 9, 2002, now Pat. No. 6,889,773.

(51) Int. Cl.
*B05B 7/06* (2006.01)

(52) U.S. Cl. ..... 239/432; 239/310; 239/311; 239/318; 239/343; 239/424; 239/433; 239/521; 239/523; 239/590; 239/590.5; 169/14; 169/15

(58) Field of Classification Search ..... 169/14, 169/15; 239/77, 310, 318, 343, 422, 424, 239/428, 432, 518, 521, 523, 524, 525, 590, 239/590.3, 590.5, 152, 311, 419, 369, 370
See application file for complete search history.

(56) References Cited

U.S. PATENT DOCUMENTS 1,364,281 A * 1/1921 Justice ..... 239/590
2,597,913 A * 5/1952 Webster ..... 169/15
2,695,069 A * 11/1954 Boerner ..... 239/590.5

(Continued)

FOREIGN PATENT DOCUMENTS

EP 0608140 7/1994

(Continued)

OTHER PUBLICATIONS

PCT International Search Report dated Sep. 24, 2003.

(Continued)

*Primary Examiner*—Steven J. Ganey
(74) *Attorney, Agent, or Firm*—McCarter & English, LLP

(57) ABSTRACT

Systems and methods for high volume, low pressure foam generation are provided that have a wide range of applications, particularly in fire fighting and fire prevention fields. The foam may be effectively delivered to targets that have heretofore been difficult, if not impossible, to reach in a timely, cost effective and/or efficacious manner. Nozzles and nozzle-containing systems are provided for combining water, injected foam and air to generate and/or deliver high volume, low pressure foam. The foam generation systems may be part of portable units that may be worn or otherwise supported by a user (e.g., a back pack), manually transported (e.g., a push cart), or transported with power-assistance (e.g., a power-assist cart). The systems may also be vehicle-mounted. Exemplary nozzle systems include a diffuser unit that facilitates aeration of the water and foam mixture that is fed to the nozzle system. Further nozzle systems include a plurality of circumferentially arrayed nozzle jets directed toward a central axis of the housing for combination with an air flow that is fed thereto.

7 Claims, 8 Drawing Sheets

U.S. PATENT DOCUMENTS

| | | | | | |
|---|---|---|---|---|---|
| 2,868,301 | A | * | 1/1959 | Wledorn | 169/15 |
| 2,988,343 | A | * | 6/1961 | Edwards et al. | 169/15 |
| 3,094,171 | A | * | 6/1963 | Gagliardo | 169/15 |
| 3,199,790 | A | * | 8/1965 | Giesemann | 239/428 |
| 3,342,271 | A | * | 9/1967 | Anthony, Jr. | 169/15 |
| 3,393,745 | A | | 7/1968 | Durstewitz | |
| 3,424,250 | A | | 1/1969 | Thomae | |
| 3,607,779 | A | | 9/1971 | King et al. | |
| 3,780,812 | A | | 12/1973 | Lambert | |
| 4,186,772 | A | | 2/1980 | Handleman | |
| 4,420,047 | A | * | 12/1983 | Bruensicke | 239/417 |
| 4,595,142 | A | | 6/1986 | Kawaharazuka et al. | |
| 4,925,109 | A | * | 5/1990 | Flanagan et al. | 239/432 |
| 5,337,830 | A | | 8/1994 | Bowman | |
| 5,787,989 | A | | 8/1998 | Elmenhorst | |
| 6,267,183 | B1 | | 7/2001 | Smagac | |

FOREIGN PATENT DOCUMENTS

| | | |
|---|---|---|
| FR | 2543840 | 10/1984 |

OTHER PUBLICATIONS

DISS Nuts, Nipples and Body Adaptors; AY Corporation; www.baycorp.com; promotional article.

CGA DISS Series; Parker Instrumentation; Advanced Literature Product Marketing May 2002.

Scope, application and definitions; www.safetyinfo.com.

Northcutt; Greg; "Downsizing for Hydraulic Seeding Success"; Erosion Control; Jan./Feb. 2001.

* cited by examiner

SYSTEMS AND METHODS FOR GENERATING HIGH VOLUMES OF FOAM

CROSS REFERENCE TO RELATED APPLICATIONS

The present application is a continuation-in-part application that claims the priority benefit of a commonly assigned, application entitled "Fire Fighting Adapter for Converting a Conventional Back Pack Blower into a Water and Foam Fire Fighter," which was filed on Dec. 9, 2002, and assigned Ser. No. 10/315,314, now U.S. Pat. No. 6,889,773, the entire contents of which are hereby incorporated by reference.

BACKGROUND

1. Field of the Invention

The present disclosure is directed to systems and methods for generating high volumes of foam and, more particularly, to systems and methods for foam generation that are capable of advantageously producing high volume, low pressure foam. The disclosed systems and methods for foam generation are efficient and useful in a variety of conditions and circumstances.

2. Background Art

Compressed air foam systems provide a powerful tool for many applications. Many traditional compressed air foam systems combine water, foam solution, and air from a compressor and then pump the mixture through a hose, thus creating compressed air foam. A traditional system for generating foam includes a water pump, water tank, foam injection pump, air compressor, a mixing chamber to mix water, foam and air, and controls necessary for mixing the three agents while maintaining the pressure. The mixture of air, water and foam may then be delivered through a hose.

Some of the shortcomings associated with traditional systems and methods for generating foam are illustrated by the following discussion. A water pump used on a firefighting vehicle is usually capable of producing water pressures from about 250 to about 400 psi and delivering about 40 to 60 gallons per minute (gpm) of water. Presently available air compressors are usually capable of delivering compressed air at about 30 to about 200 cubic feet per minute (cfm) at about 150 psi, with a maximum of 200 psi achieved by high-performance units. In conventional foam generation systems, the air, water and foam must all operate at the same pressure, e.g., at the firetruck or other foam generation location, and pressure control systems must be provided to ensure that the pressures are appropriately equalized. For example, if the water pressure is too high, mixing of with the compressed air cannot be effected. Thus, when traditional systems for generating foam are used with the presently available water pumps and air compressors, the limited compressor discharge pressure and volume capacity are limiting factors.

More particularly, the limited capabilities of the air compressor restrict the overall pressure that the entire system is capable of delivering, i.e., conventional foam generation systems may be limited to about 200 psi maximum. The flow of foam encounters significant friction loss when transmitted through hoses according to conventional foam generation systems. Indeed, these friction losses can significantly impede or back up the flow of foam in conventional systems. Because conventional systems are limited to outlet pressures of 150–200 psi based on the available air pressure, the potential utility of foam generation systems is significantly restricted or completely defeated in a variety of important fields and applications.

Once the water/foam and high pressure air are combined, e.g., in a compressed air system positioned on a firetruck, the high pressure foam must be transported to the desired target. Such foam transport is generally accomplished by way of a conventional fire hose that ranges in diameter from 1" to 2½". Conventional compressed air foam systems are more effective when larger diameter fire hoses are employed, but have limited potential for use with smaller diameter hoses, e.g., ⅝" to 1" hoses. These smaller diameter fire hoses are widely employed for brush fire and wildland/urban interface applications.

The following examples further illustrate the significant limitations associated with conventional compressed air foam systems. In fighting wildland and/or brush fires, hoses of one foot diameter are typically employed, and such hoses generally stretch about 300 feet from the truck to the fire nozzle. Fire fighting systems generally deliver a flow rate of 60 gpm from the truck to the nozzle. The friction loss at 60 gpm for a 1' diameter rubber hose is approximately 276 psi. If a "high quality" compressor delivers air to the foam generation system at a pressure of 200 psi, the system is still 76 psi below the pressure required to overcome the friction forces of the hose, without even taking into account the approximately 100 psi required at the nozzle to effect the desired discharge. Even if the flow rate were reduced to 40 gpm, the friction loss for a 1' diameter rubber hose would be approximately 132 psi. Thus, at best, only 70 psi would be available at the nozzle to effect foam discharge, which falls short of the desired 100 psi.

Various systems for foam generation have been provided in the patent literature. For example, U.S. Pat. No. 3,393,745 to Durstewitz describes fire-fighting foam generating apparatus and, more particularly an apparatus which includes a centrifugal fan, a cylindrical foam forming net surrounding the fan, a source of foam producing solution under pressure, and a plurality of reaction nozzles mounted on the fan rotor for spraying the solution onto the net and for driving the fan rotor by the reaction forces thus produced to pump air outwardly through the net to generate high expansion foam. Another system for foam generation is provided in the U.S. Pat. No. 3,424,250 to Thomas, which describes an apparatus for entraining air in a mixture of water and detergent compound to form a foam and then entraining further air in the foam to provide a high expansion foam for use in fire fighting.

U.S. Pat. No. 3,607,779 to King et al. describes a tubular housing with a rear inlet and a front end outlet that has a foraminous cover over its front end. A shaft extends lengthwise of the inside of the housing and is rotatably supported. It is driven by a water turbine on its front end, the turbine having an inlet for water under pressure and a central front outlet that delivers the water to a forwardly directed nozzle connected to the turbine. Rigidly mounted on the shaft behind the turbine is a fan for blowing air through the housing from back to front. Also mounted on the shaft is a pump for delivering foaming solution to the rear end of the nozzle to mix with the water from the turbine outlet.

U.S. Pat. No. 3,780,812 to Lambert describes a fire protection method and apparatus for generating a high expansion foam. The method includes fluidizing the foams by wetting. The apparatus includes a housing having a source of foam solution under pressure and a source of water under pressure. The housing includes a fan and a perforated member. The fan is positioned in the housing to provide air flow across the perforated member which is wetted by the foam solution to produce high expansion foam bubbles. The fan is driven by a plurality of nozzles mounted both for discharging the water under pressure and for wetting the foam bubbles.

U.S. Pat. No. 5,337,830 to Bowman describes a system for generating fire-fighting foam whereby a foam-forming chemical is mixed with water and air to form foam. The foam is pressurized preferably by the provision of pressurized air to force the foam out of a duct within which the foam is formed and to direct the foam at the seat of the fire or to the site to be protected against fire. A metal mesh is rotatable and preferably helical with respect to the direction of travel of the foam which acts as a catalytic agent and helps to clear foam from the duct within which the foam forms.

U.S. Pat. No. 5,787,989 to Elmenhorst describes a fan casing and a fan which are operated by a reaction jet motor. The reaction jet motor has nozzles and is connected to a liquid under pressure, usually water with a foaming agent added. When the liquid is sprayed from the nozzles, the reaction forces will operate the fan. The nozzles are designed in such a manner that they generate a cohesive and compact jet with high thrust. A grid is located between the nozzles and the foam net for atomization and dispersion of the liquid. The air blows the liquid through the foam net, thus generating fire-fighting foam.

U.S. Pat. No. 4,595,142 to Kawaharazuka et al. describes a blower/spray device which includes a tank containing a liquid chemical agent that is removably mounted on a main body, an air extracting line secured to the upper portion main body, and an air introducing member secured to the bottom wall of the tank and aligned with the outlet of the air extracting line. The blower is driven by an internal combustion engine.

Although the prior art systems and methods described above (and other presently used systems and methods for foam generation) may result in adequate foam generation for the specific and limited purposes for which they are used, these prior art systems and methods fail to generate foam in a way and of a quality for widespread and effective use.

Thus, there remains a need for systems and methods for foam generation that are capable of producing relatively high volumes of foam that can be effectively delivered when and where needed. Further, there remains a need for systems and methods for foam generation that overcome the pressure-related limitations of conventional foam generation systems.

SUMMARY OF THE PRESENT DISCLOSURE

The present disclosure provides advantageous systems and methods for foam generation and, more particularly, advantageous foam generation systems and methods having a wide range of applications, particularly in fire fighting and fire prevention fields. The advantageous systems and methods of the present disclosure permit efficient, advantageous foam generation—at high volume, but at low pressure—such that the foam may be effectively delivered to targets that have heretofore been difficult, if not impossible, to reach in a timely, cost effective and/or efficacious manner. Thus, as will be apparent from the detailed description and appended figures which follow, the present disclosure provides, inter alia, the following advantageous advances to the field of foam generation:

- Systems and methods for generating high volume, low pressure foam.
- Apparatus (including nozzles and nozzle-containing systems) for combining water, injected foam and air to generate and/or deliver high volume, low pressure foam.
- Portable units for generating high volume, low pressure foam, including units that may be worn or otherwise supported by a user (e.g., a back pack), units that may be manually transported (e.g., a push cart), or units that may be transported with power-assistance (e.g., a power-assist cart).
- Vehicle-mounted systems and units for generating high volume, low pressure foam.
- Advantageous foam applications for enhancing safety and/or property protection/preservation, including applications wherein large amounts of high volume, low pressure foam are delivered to a target in anticipation of, in response to and/or in preparation for threatening conditions, e.g., in response to a forest fire in close proximity to a dwelling, structure or item(s) of personal property (e.g., boat, car, truck or the like).

According to exemplary embodiments of the present disclosure, foam generation systems and methods for generating high volume, low pressure foam are provided. These systems and methods inject large amounts/volumes of air at high velocity, but at low pressure, into a supply and/or stream of water and injected foam material. Thus, according to exemplary embodiments hereof, water and foam are combined at a desired ratio, e.g., in a feed tank or using an inline apparatus for combined flow, e.g., an eductor. The water/foam mixture is fed to an apparatus or device wherein the water/foam mixture is advantageously combined with pressurized air to create large volumes of aerated foam.

The aerated foam is delivered to a desired target, e.g., one or more burning structure(s)/item(s) and/or structure(s)/item (s) that are to be safeguarded from flame. Alternative applications are also contemplated, e.g., applications of foam insulation, delivery of biological and/or chemical agents, pest and insect control agents, and the like. The disclosed systems and methods are not limited by relative pressure requirements for the water/foam feed line and the compressed air line in the way prior art systems have been limited. Thus, the disclosed systems and methods advantageously deliver high volume, low pressure foam to the desired target, thereby greatly enhancing the utility and effectiveness of the disclosed foam generation systems/methods.

According to exemplary embodiments of the present disclosure, advantageous nozzle and nozzle-containing systems are provided for generating high volume, low pressure foam. The disclosed nozzles include a first inlet for a water/foam mixture, a second inlet for ingress of an air flow, a region or chamber for combining the water/foam mixture and the air, and a discharge outlet for delivering large volumes of aerated foam to or toward desired target(s). One or more flow control mechanisms (e.g., manually controlled valves) are generally provided to permit regulation of the flow of the water/foam mixture and/or the air into the nozzle. A flow control mechanism may also be provided for regulating the discharge flow. Such flow control mechanisms permit users to control and/or regulate the ratio of water/foam and air, as well as the relative velocity/trajectory of the discharged aerated foam. Control of such flow parameters may also be regulated, in whole or in part, based on control of feedstock parameters, e.g., pump settings/properties for the water/foam flow and blower/compressor settings/properties for air flow.

Pressure gauge(s) may be included for measuring the line pressures of one or more flow lines associated with the disclosed nozzle and nozzle-containing system according to the present disclosure. Thus, for example, a pressure gauge may be associated with the water/foam flow line that feeds the nozzle assembly. Similarly, one or more flow meters may be associated with the disclosed system, to permit regulation and control of system flow parameters, e.g., into and out of the disclosed nozzle assembly.

Exemplary nozzle systems according to the present disclosure include a diffuser for facilitating foam generation and, more particularly, for effecting a desired combination of a water/foam stream with an air stream. The diffuser generally includes a dispersing element, e.g., a cone, that faces toward the water/foam discharge. Thus, in an exemplary nozzle system according to the present disclosure, the diffuser includes a centrally positioned cone-shaped member and a plurality of fin-like blades for effecting a desired flow pattern and contributing to generation of a desired level of mixing. The water/foam stream contacts the dispersing element and forms a relatively thin film which is contacted by the air flow, which enters the diffuser in high volumes, but at low pressure. Blades may be provided in the diffuser which bisect the flow path of the air and water/foam streams as they pass toward the discharge outlet. The blade structures may also serve, at least in part, to support the dispersing element, e.g., the cone, in the desired location for dispersion of the water/foam stream.

In a further exemplary embodiment of the present disclosure, the diffuser includes a plurality of nozzle jets for delivery of the water/foam mixture to a mixing region. The nozzle jets may be annularly arranged in a spaced, side-by-side manner. According to exemplary nozzle embodiments, air enters the mixing region by way of a central passage that delivers air through a conduit positioned within the annularly arranged nozzle jets. A dispersing element may be included as part of a diffuser, the dispersing element serving to further disperse the water/foam stream for combination with the air stream passing therethrough.

According to the present disclosure, portable units for generating high volume, low pressure foam are provided. The disclosed portable units generally cooperate with a source of water that may be pumped from a truck, tank, pond, swimming pool or the like. Foam may be injected/added to the water at the water source, e.g., in the noted tank, or may be combined/mixed with the water at a subsequent point, e.g., by way of an in-line eductor as the water is pumped to the portable unit. Air is generally combined with the water/foam stream at the portable unit, thereby avoiding the pressure drop issues and pressure equalization issues that have limited prior art foam delivery systems.

In exemplary embodiments of the present disclosure, the portable unit may be worn or otherwise supported by a user, e.g., as a back pack, and includes a source of air flow for combination with the water/foam stream, e.g., an air blower or light-weight compressor. Alternatively, the portable unit may be a wheeled structure that is manually transportable, e.g., a push cart, wagon or the like. A blower or compressor may be supported by the wheeled structure, and may feed a mixing nozzle in proximity thereto. In an exemplary embodiment of the present disclosure, the nozzle assembly is mounted to the wheeled structure, thereby further enhancing the versatility and ease of use associated therewith. In a further exemplary embodiment, a portable unit is provided that includes a power-assist mechanism for transport thereof, e.g., a power-assist cart or wagon. As with the manually transportable wheeled structure, the power-assist unit includes a blower or compressor for supplying an air flow to a nozzle system for combination with a water/foam stream. The disclosed portable units advantageously facilitate generation and delivery of high volume, low pressure foam to desired targets in a variety of conditions and circumstances.

Vehicle-mounted systems and units for generating high volume, low pressure foam are also disclosed herein. Thus, according to exemplary embodiments of the present disclosure, a source of air flow, e.g., a compressor or blower, a source of pumped water with foam added/injected thereto, and a nozzle system for generating and delivering high volume, low pressure foam are mounted, in whole or in part, on a vehicle, e.g., a firetruck. Indeed, operative portions of the disclosed systems and units may be mounted to the bumper of a firetruck, thereby facilitating ease of access and use thereof.

The high volume, low pressure foam that is generated according to the present disclosure has numerous advantageous uses. Thus, for example, the disclosed systems and units for generating foam may be employed in delivering foam so as to enhance safety and/or property protection/preservation. In exemplary embodiments of the present disclosure, high volume, low pressure foam may be delivered to a target in anticipation of, in response to and/or in preparation for threatening conditions, e.g., in response to a forest fire in close proximity to a dwelling, structure or item(s) of personal property (e.g., boat, car, truck or the like). Alternative applications disclosed herein include the generation of high volume, low pressure foam materials for foam insulation applications, delivery of biological and/or chemical agents, delivery of pest and insect control agents, and other applications wherein a foamed or aerated composition is to be delivered to or toward a desired target.

Thus, for example, the disclosed systems and methods may be employed in controlling and/or killing dangerous insects such as the South American killer bees, from a long range with very little foam and water. Biological and chemical suppressing foam may be also be generated and delivered through the disclosed nozzle systems and associated methods for high expansion use in filling buildings, cars, etc. Agricultural uses for the disclosed systems and methods include the discharge of water and agents on crops, where the air flow introduced to the disclosed nozzle systems will help deliver and expand the involved chemicals. Moreover, the disclosed systems and methods may be employed in maintenance procedures and applications as a high powered water/foam surfactant discharge agent, e.g., for the purpose of washing surfaces, sidewalks and the like.

These and other aspects of the disclosed system and methods of using the same will become more readily apparent to those having ordinary skill in the art from the following detailed description taken in conjunction with the drawings provided hereinbelow.

BRIEF DESCRIPTION OF THE DRAWINGS

So that those having ordinary skill in the art to which the present disclosure pertains will more readily understand how to make and use the subject invention, exemplary embodiments thereof will be described in detail hereinbelow with reference to the drawings, wherein.

DETAILED DESCRIPTION OF EXEMPLARY EMBODIMENT(S)

Advantageous systems and methods for foam generation having a wide range of applications, particularly in fire fighting and fire prevention fields, are disclosed herein. These systems and methods permit efficient, advantageous foam generation—at high volume, but at low pressure—such that the foam may be effectively delivered to virtually any desired target. In each of the exemplary embodiments disclosed herein, high volume, low pressure foam may be generated and delivered to targets, e.g., for fire fighting and/or fire prevention purposes.

In the detailed description which follows, various exemplary embodiments are described, particularly with reference to the figures appended hereto. However, the particularly disclosed embodiments are merely illustrative of apparatus (including nozzles and nozzle-containing systems) that may be used to combine a fluid (e.g., water), a foam material (e.g., a conventional fire fighting foam material), and a gaseous stream (e.g., air) to generate and deliver high volume, low pressure foam, according to the present disclosure. Thus, for example, advantageous apparatus for generating high volume, low pressure foam may take the form of portable units, including units that may be worn or otherwise supported by a user (e.g., a back pack), units that may be manually transported (e.g., a push cart), and units that may be transported with power-assistance (e.g., a power-assist cart). Advantageous apparatus for generating high volume, low pressure foam may also include systems and units that are (at least in part) vehicle-mounted.

The generation and delivery of high volume, low pressure foam, as disclosed herein, may be used to extinguish fires and/or to enhance safety and/or property protection/preservation, e.g., by applying large amounts of high volume, low pressure foam to a target in anticipation of, in response to and/or in preparation for threatening conditions. Thus, the disclosed foam generation technology and associated apparatus may be used to deliver high volume, low pressure foam to any desired target, whether already combusting or as a precautionary measure, e.g., in response to a forest fire in close proximity to a dwelling, building or item of personal property (e.g., boat, car, truck or the like). The disclosed systems and methods may also be used in alternative applications, e.g., delivery of high volume, low pressure foam materials in foam insulation applications, delivery of biological and/or chemical agents, delivery of pest and insect control agents, and other applications wherein a foamed or aerated composition is to be delivered to or toward a desired target.

Figure 1:
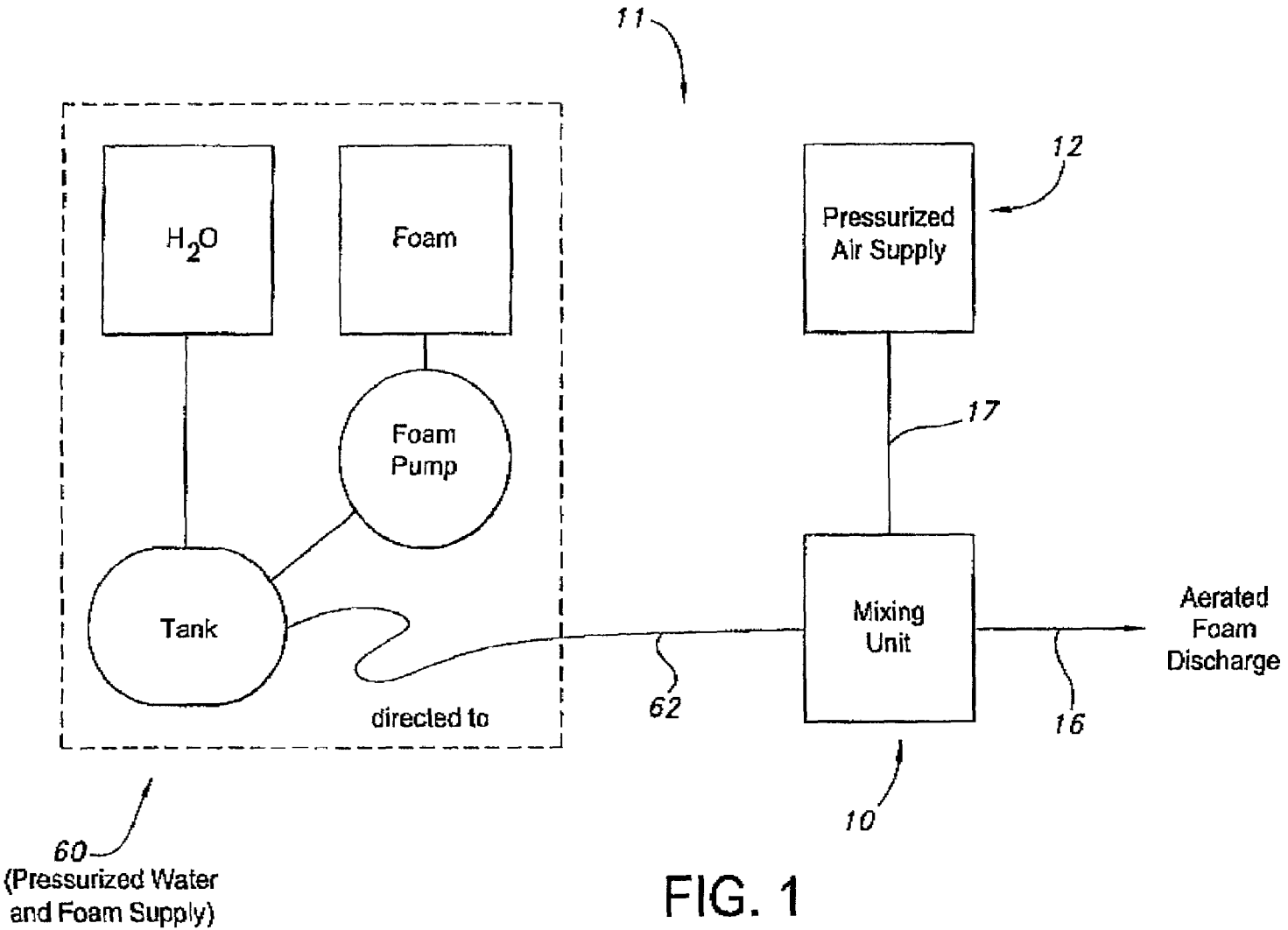
FIG. 1 is a diagrammatic view of an exemplary foam generation system according to the present disclosure, wherein the system is connected to a pressurized water and foam supply and to a pressurized air supply.

Referring now to the figures, wherein like reference numerals identify similar structural elements of the apparatus and systems described herein, FIG. 1 is a diagram schematically depicting an exemplary system 11 for generating high volumes of foam that includes a mixing unit 10, a pressurized air supply 12 in communication with the mixing unit 10 and connected thereto by a discharge tube 17, and a pressurized water and foam supply 60 in communication with the mixing unit 10 and connected thereto by means of a pipe, line or flexible hose 62.

The pressurized air supply 12 introduces pressurized air to the mixing unit 10 for combination with a supply of water/foam that is fed thereto, such that aerated foam is discharged from mixing unit 10, e.g., through a nozzle assembly associated with or integral to mixing unit 10, directly to or toward a desired target. Stated differently, aerated foam need not be transmitted for any significant distance within a pipe, hose or other enclosed structure according to the present disclosure, thereby minimizing potential pressure drops and associated difficulties that are inherent in the prior art systems for pumping aerated foams. Rather, according to the present disclosure, aeration of a water/foam mixture takes place immediately prior to, and in spatial proximity to, the point of foam discharge.

Consistent with the wide ranging utility and widespread application of the high volume, low pressure foam generation technology of the present disclosure, pressurized air supply 12 may be derived from a variety of sources. Thus, for example, pressurized air may be supplied to mixing unit 10 using a conventional compressor or air blower, e.g., a stationary air blower, a chassis- or wheel-mounted blower, an industrial leaf blower, a back pack blower, a compact leaf blower, or any other device or structure that is capable of performing a similar function. Any of such pressurized air supplies may be driven by an internal combustion engine or the like, and may be arranged, configured and fixtured to deliver pressurized air to mixing unit 10. While the present disclosure contemplates the use of ambient air for generation of aerated foam within mixing unit 10, the disclosed systems and methods are not limited thereto, and aeration may be achieved using any desirable gaseous system without departing from the spirit or scope of the present disclosure. For example, in non-fire fighting applications, it may be desirable to incorporate a fungicide, insecticide or other active agent into the gaseous stream before the aeration step, thereby enhancing the efficacy and efficiency of the disclosed system and methodology.

As schematically depicted in the exemplary embodiment of FIG. 1, water and foam are combined prior to being introduced to mixing unit or nozzle 10. As further depicted in FIG. 1, water and foam are combined in a tank or other chamber of suitable volume. Depending on the residence time of the water/foam mixture within the tank/chamber, it may be desirable to include an agitation mechanism to ensure a desired level of homogeneity/dispersion of the foam within the water. As discussed in greater detail below, alternative systems for combining the water with the foam may be employed, e.g., eductors (in-line, bypass or selfeducting nozzles), around-the-pump proportioning systems, balanced pressure pump proportioning systems, and/or direct injection proportioning systems. Selection of a suitable system or mechanism for combining the water and foam is generally based on parameters such as cost considerations, spatial limitations, the manner in which the water and foam are sourced and stored prior to combination, portability of the system, and the like, as will be apparent to persons skilled in the art.

A variety of foam materials may be employed according to the present disclosure. As used herein, in the context of fire fighting and/or fire prevention systems, a "foam material" is a material that is adapted to form a stable aggregation of small bubbles which flow freely over a burning liquid surface and form a coherent or substantially coherent blanket which seals combustible vapors and is thereby adapted to extinguish, prevent and/or impede a fire. Foam materials according to the present disclosure may be used in connection with various classes of fires, e.g., Class A and Class B fires. Thus, for example, aqueous film forming foams that include fluorinated surfactant(s) and foam stabilizer(s) may be employed according to the present disclosure, such foams generally developing an aqueous film on the fuel surface of some hydrocarbons which is capable of suppressing the generation of further fuel vapors. Foam materials may be stored in a tank, bin or alternative storage container, and may be in the form of a foam concentrate, powder, emulsion or other conventional form before combination with the water supply, e.g., in the tank or alternative mixing system of the present disclosure.

The water that is combined with the foam may be sourced from a tank or other pre-filled water storage vessel, or may be obtained from water sources that are available on location, e.g., a pond, lake, river, swimming pool, hydrant, standpipe, well or the like. The temperature and purity of the water are generally not critical to operation of the systems and methods of the present disclosure, although it is desirable that the water be of sufficient clarity that nozzle jets, mixing components, pumping components and discharging/ejecting components are not plugged or otherwise blocked by water-based impurities. Thus, it may be desirable to include a filtering unit in connection with the sourcing of water, particularly water that is sourced on location, according to the disclosed systems and methods.

Once the water and foam are combined, e.g., as schematically depicted in FIG. 1, water and foam supply 60 is pumped to mixing unit by way of pipe, line or flexible hose 62. A control system is generally provided to regulate the pumping of water/foam through hose 62, and may include an on/off control switch and/or a flow rate control mechanism. The on/off control mechanism may control power to the pump, or control valving associated with fluid flow into hose 62. Mixing unit 10 is generally configured to facilitate mixing of a water/foam stream that is pumped from water and foam supply 60 with compressed air that is delivered from pressurized air supply 12, and may advantageously take the form of a portable hand-held nozzle system, a stationary (e.g., fixedly mounted) nozzle system, a nozzle system mounted on a wheeled structure (e.g., a cart or wagon), or a nozzle system attached or mounted (in whole or in part) to a vehicle.

Figure 2:
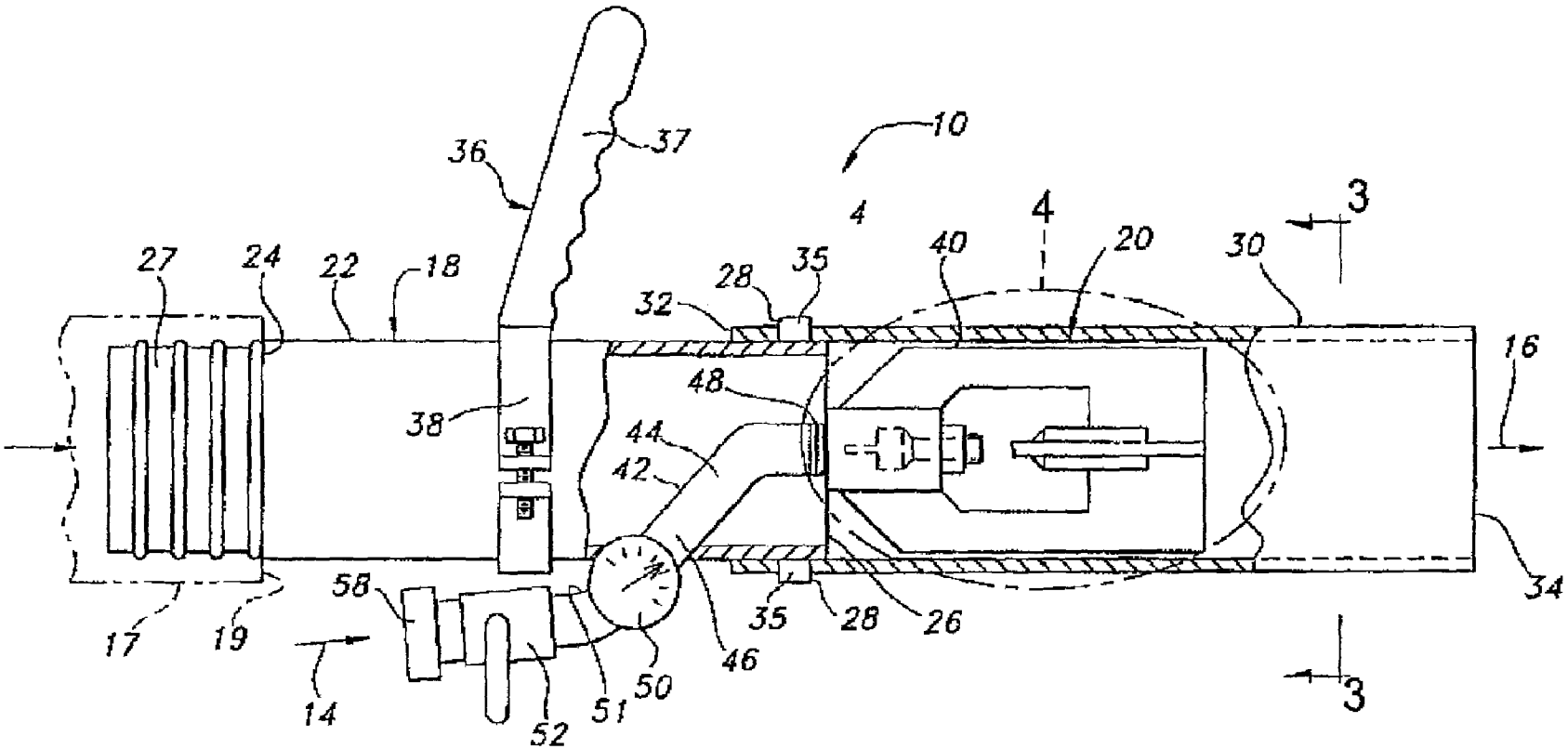
FIG. 2 is an enlarged partially broken away view of an exemplary device for use in foam generation according to an exemplary embodiment of the subject disclosure.
Figure 3:
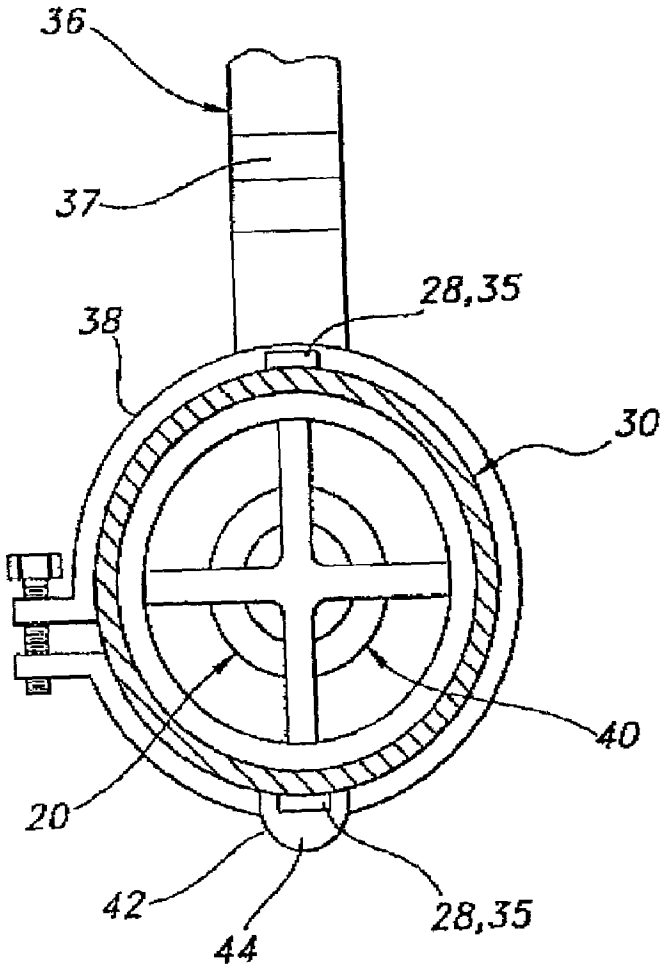
FIG. 3 is an enlarged cross sectional view of the exemplary foam generation device of FIG. 2, taken along line 3—3 therein.

An exemplary embodiment of a mixing unit 10 for generating high levels of foam is shown in greater detail in FIGS. 2 and 3. Exemplary mixing unit 10 includes a housing 18 and a diffuser unit 20. The housing 18 has a proximal end, a distal end and an inner chamber. The proximal end of housing 18 may be attached to, and may be in communication with, the free end 19 of the discharge tube 17 which is connected to pressurized air supply 12. Thus, the proximal end of housing 18 advantageously receives a flow of compressed air from pressurized air supply 12. Housing 18 accommodates the diffuser unit 20 within the housing's inner chamber. The diffuser unit 20 advantageously diffuses the water and foam mixture 14 and facilitates combination with the compressed air that is introduced through free end 19 of discharge tube 17. The resulting super-aerated foam mixture 16 is then propelled or discharged out of the housing 18.

Referring further to FIGS. 2 and 3, exemplary housing 18 includes an air discharge tube 22. The air discharge tube 22 defines a proximal end 24, which corresponds to the proximal end of the housing 18, and a distal end 26. Housing 18 also defines a ribbed connector 27 in communication with the proximal end 24 of the air discharge tube 22. Ribbed connector 27 is adapted for coaxial engagement with the free end 19 of discharge tube 17 that communicates with pressurized air supply 12. Alternative mechanisms for detachably securing housing 18 relative to discharge tube 17 may be employed, e.g., threaded connections, bayonet locking mechanisms, snap-fit connections and the like. According to exemplary embodiments, the mechanism employed for detachably securing housing 18 relative to discharge tube 17 is relatively secure, can withstand the pressures involved without becoming disengaged, and permits ease of use, e.g., quick disconnection/reconnection if it is desired to redirect the pressurized air to an alternate nozzle system.

According to exemplary embodiments of the present disclosure, housing 18 is fabricated (at least in part) from a non-corrosive material, e.g., aluminum, although alternative materials are contemplated, e.g., stainless steel, high-strength plastics and the like. Mixing unit 10, including housing 18, may be fabricated by conventional machining techniques and/or casting technologies, as will be apparent to persons skilled in the art.

Exemplary air discharge tube 22 includes a plurality of outwardly extending snap connectors 28 (two connectors pictured in FIG. 2). Snap connectors 28 are radially arrayed around the periphery of discharge tube 22, and in the case of two connectors (as depicted) are diametrically opposed to each other. Snap connectors 28 engage cooperative apertures 35 formed in expansion tube 30, which is substantially axially aligned with housing 18. Cooperation of snap connectors 28 with apertures 35 permits expansion tube 30 to selectively snap on and off air discharge tube 22 and advantageously allows the diffuser unit 20 to be exposed, accessed and serviced. However, other structures and methods for removably or permanently securing expansion tube 30 to the air discharge tube 22 are contemplated to be within the subject disclosure, including threaded connections, bayonet locking mechanisms, other forms of snap-fit connections and the like.

Expansion tube 30 defines a proximal end 32 and an open distal discharge end 34. As noted above, in the exemplary embodiment depicted in FIG. 2, the proximal end 32 of the expansion tube 30 coaxially receives, and communicates with, the distal end 26 of air discharge tube 22.

In exemplary embodiments of the present disclosure illustrated in FIGS. 2 and 3, housing 18 further includes a handle assembly 36. The handle assembly 36 preferably includes a handle 37 and a screw clamp 38. In an exemplary embodiment of FIG. 2, the handle 37 extends radially outwardly, and slightly forwardly, from the air discharge tube 22, and is maintained thereat by the screw clamp 38 that depends therefrom and circumferentially engages the air discharge tube 22. Handle 37 generally includes surface features that facilitate gripping and handling thereof, e.g., the substantially serrated edge surface depicted in FIG. 2. Alternative handle features may be employed to facilitate gripping and handling thereof, e.g., texturized surfaces and the like.

Figure 4:
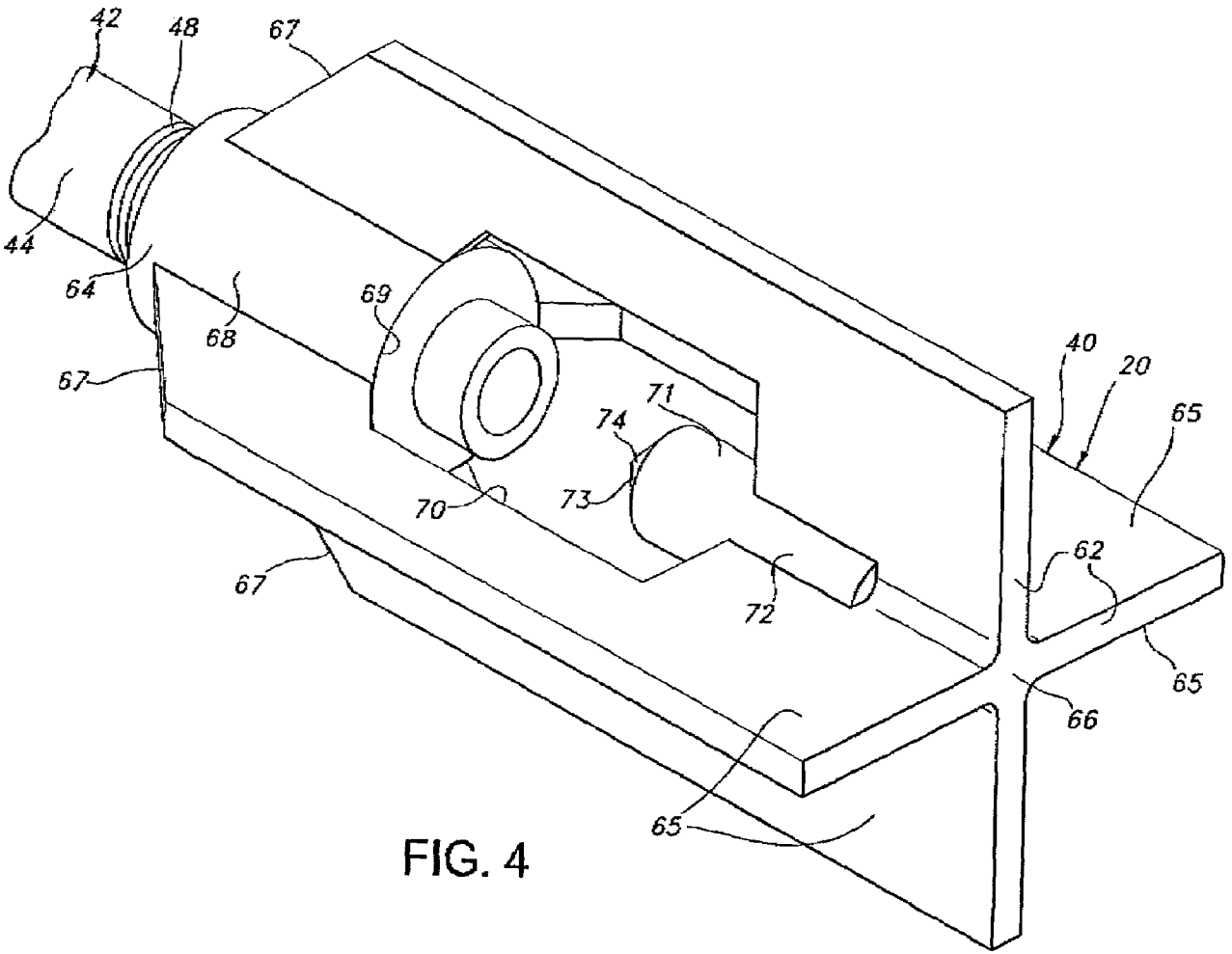
FIG. 4 is an enlarged perspective view of the area generally enclosed by the dotted ellipse identified by arrow 4 in FIG. 2, which represents an exemplary diffuser according to the present disclosure.
Figure 5:
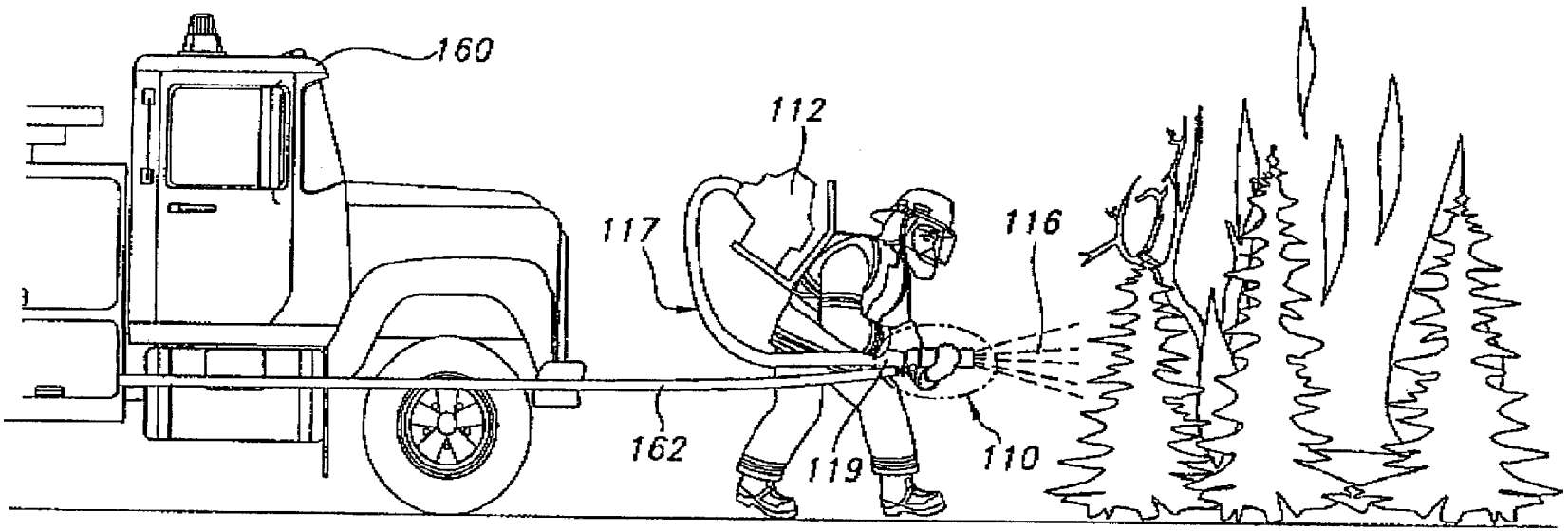
FIG. 5 is a schematic illustrating an application of an exemplary portable unit according to the present disclosure.

Referring now to FIGS. 2, 3 and 4, exemplary diffuser unit 20 includes a diffuser 40 and a water and foam delivery system 42. The diffuser 40 preferably extends substantially coaxially in the housing 18 and most preferably in the expansion tube 30. The water/foam delivery system 42 preferably extends into and through a portion of the air discharge tube 22, communicating with diffuser 40 at a discharge end thereof.

Exemplary water/foam delivery system 42 includes a water/foam delivery tube 44. The water/foam delivery tube 44 defines a proximal end 46 and a distal end 48. The distal end of water/foam delivery tube extends substantially along the central axis of air discharge tube 22 and is disposed coaxially with respect to diffuser 40. The proximal end 46 of water/foam delivery tube 44 is disposed (at least in part) outside the air discharge tube 22. Thus, water/foam delivery tube 44 provides for the ingress of water/foam into the mixing region of mixing unit 10, by passing through the external wall of air discharge tube 22.

The region in which water/foam delivery tube 44 passes through the external wall of air discharge tube is sealed using conventional sealing materials. Alternatively, air discharge tube 22 may be provided with a fitting to facilitate the introduction of water/foam through the wall thereof, and the internal portions of water/foam delivery tube 44 may be integral with housing 18. Thus, the precise structural arrangement by which the feed line for water/foam is introduced to the central axis of discharge tube 22 is not critical, provided system pressure is maintained and pressure drops are not increased to unacceptable levels.

The exemplary water/foam delivery system 42 further includes a pressure gauge 50. The pressure gauge 50 generally has communicates with the flow system within delivery system 42 by way of a fitting 51 and is advantageously positioned for unobstructed viewing. Pressure gauge 50 allows users to monitor water/foam pressure to ensure continued flow of water/foam into mixing unit and optimal operation of mixing unit 10. Alternative pressure gauge systems may be employed, e.g., systems with digital readouts and automatic feedback controllers, as will be apparent to persons skilled in the art. Water/foam delivery system 42 further includes a manual on/off control valve 52. Alternative mechanisms for controlling the flow of water/foam may be employed, e.g., electronically controlled valve systems. The water/foam delivery system 42 also includes a connection fitting 58 which facilitates connection to a source of water and foam 16, e.g., a tank located on a fire engine 60 or the like. Any conventional connection fitting may be employed.

The specific configuration of the diffuser 40 can best be seen in FIG. 4, and will be discussed with reference thereto. Diffuser 40 includes a pair of blades 62. The pair of blades 62 are plate-like and criss-cross each other perpendicularly to define a proximal end 64 and a distal end 66 of the diffuser 40, and longitudinal regions 65 between adjacent blades 62, through which the blown air travels from the air discharge tube 22. The proximal ends of blades 62 are preferably angled toward the center line of mixing unit 10, defining angled surfaces 67, such that an "arrow-head" configuration is defined. Angled surfaces 67 facilitate enhanced air flow as the pressurized air first encounters diffuser 40. Blades 62 are mounted to a tubular portion of diffuser 40 which is mounted with respect to the distal end 48 of water/foam delivery tube 44.

Tubular portion 68 is substantially aligned with the central axis of mixing unit 10 and extends distally to define a terminal end 69 that is surrounded by the four spaced blade surfaces 62. The diffuser 40 thus defines a void region 70 within the blade surfaces 62 and distal of terminal end 69, where the water/foam stream is expelled upon discharge into diffuser 40. Diffuser 40 further includes a rod 72 that is mounted to the criss-crossing blades 62 and is disposed coaxially with tubular portion 68. A cone 74 is defined on the proximal end 73 of rod 72 and is coaxially aligned with the tubular portion 68. The positioning of cone 74 is spaced alignment with the discharge of tubular portion advantageously facilitates mixing of water/foam with air, according to the present disclosure.

More particularly, as the water/foam mixture exits tubular portion 68 into void region 70, the water/foam mixture impacts the cone 74 and is dispersed radially outward in a thin umbrella-cone film. The water/foam mixture is thus flows radially outwardly and axially as it enters the regions between blades 62. Simultaneously, pressurized air is entering the spaces between blades 62 from air discharge tube 22. The air that flows into the spaces between blades 62 is characterized by high volume flow from pressurized air supply 12, but such air flow is at a relatively low pressure.

Thus, the air flow through expansion tube 30 becomes interspersed with, and functions to aerate, the dispersed water/foam mixture. The air flow through expansion tube further propels the water/foam mixture toward the distal end 34 of expansion tube 30. Thus, according to the exemplary mixing unit 10 disclosed herein, the water and foam mixture passes through the water/foam delivery tube 44 and out of the distal end 48 of the water/foam delivery tube 44 into the void region 70 within diffuser, where the water/foam mixture impacts upon the cone 74 and is diffused into the longitudinal spaces 65 formed between blades 62 to engage the blown air from the air discharge tube 22.

According to exemplary embodiments of the present disclosure, the water/foam mixture may be piped to mixing unit 10 using a pipe or flexible hose, e.g., a fire hose. Pressures of up to 400 psi can be easily attained for the water/foam flow mixture, based on conventional pump systems. The water/foam mixture is advantageously discharged at a diffuser where the mix is converted to a substantially 360° umbrella-style cone of fluid. The water/foam mixture is effectively sheared into a very thin film and the high volume, low pressure air that is introduced to the diffuser is able to mix with the water/foam mixture and produce a super-aerated foam mixture for discharge therefrom.

More particularly, the disclosed foam generation system utilizes large amounts of low pressure air to produce large volumes of foam for delivery to or toward a desired target. In an exemplary embodiment of the present disclosure, air is introduced to the mixing unit at a rate of about 650 to 680 cubic feet per minute (cfm) at a pressure of only 2–5 psi. Thus, as is readily apparent, the disclosed system overcomes the prior pressure-imposed limitations, i.e., the inability to exceed 200 psi at the pump which limited the ability to pump conventional foams over long lays of smaller diameter fire hoses.

Indeed, the advantageous foam generation system of the present disclosure operates effectively under pump conditions that are commonly employed in conventional foam generation systems. Illustrative operating conditions for the disclosed foam generation system are as follows:

60 gpm for the water/foam flow rate exiting the pump;

0.438 nozzle tip at the discharge of the mixing unit or nozzle 10;

276 psi loss for 300' fire hose run;

Pump pressure of 400 psi (leaving 124 psi at the nozzle);

124 psi at 0.438 nozzle=61 gpm;

Air introduced at the mixing unit/nozzle at 680 cfm at 2–5 psi;

Foam output at a 15:1 expansion ratio is available

Thus, in an exemplary embodiment of the present disclosure, 400 gallons of water and 2 gallons of Class A foam are pumped through the disclosed mixing unit/nozzle to produce 7000 gallons of foam.

Exemplary embodiments of the present disclosure may find application in various fields. For example, the systems for generating high volumes of foam, diffusers therefor, and associated methods may be used in a range of fire-fighting applications. In one type of such exemplary embodiments, illustrated in FIG. 4, the pressurized air supply may be take the form of a conventional back pack blower 112, which may be secured to and in communication with mixing unit/nozzle 110 for generating high volumes of foam. The internal design and operation of mixing unit/nozzle 110 conforms to the design and operation of mixing unit 10, discussed above.

The pressurized air is fed to mixing unit/nozzle 110 by means of the discharge tube 117 which is joined to mixing unit/nozzle 110 at the discharge tube's free end 119. The water and foam mixture may be supplied by from a tank associated with vehicle 60, e.g., a firetruck, by means of a hose 162. Thus, the foam generation system is substantially portable, in that the fire fighter is able to transport mixing unit/nozzle 110, within which the water/foam mixture and the air are advantageously combined. Alternative portable designs may be constructed, including designs wherein the mixing unit/nozzle are wheel mounted and potentially power-assisted for transport thereof.

Figure 6:
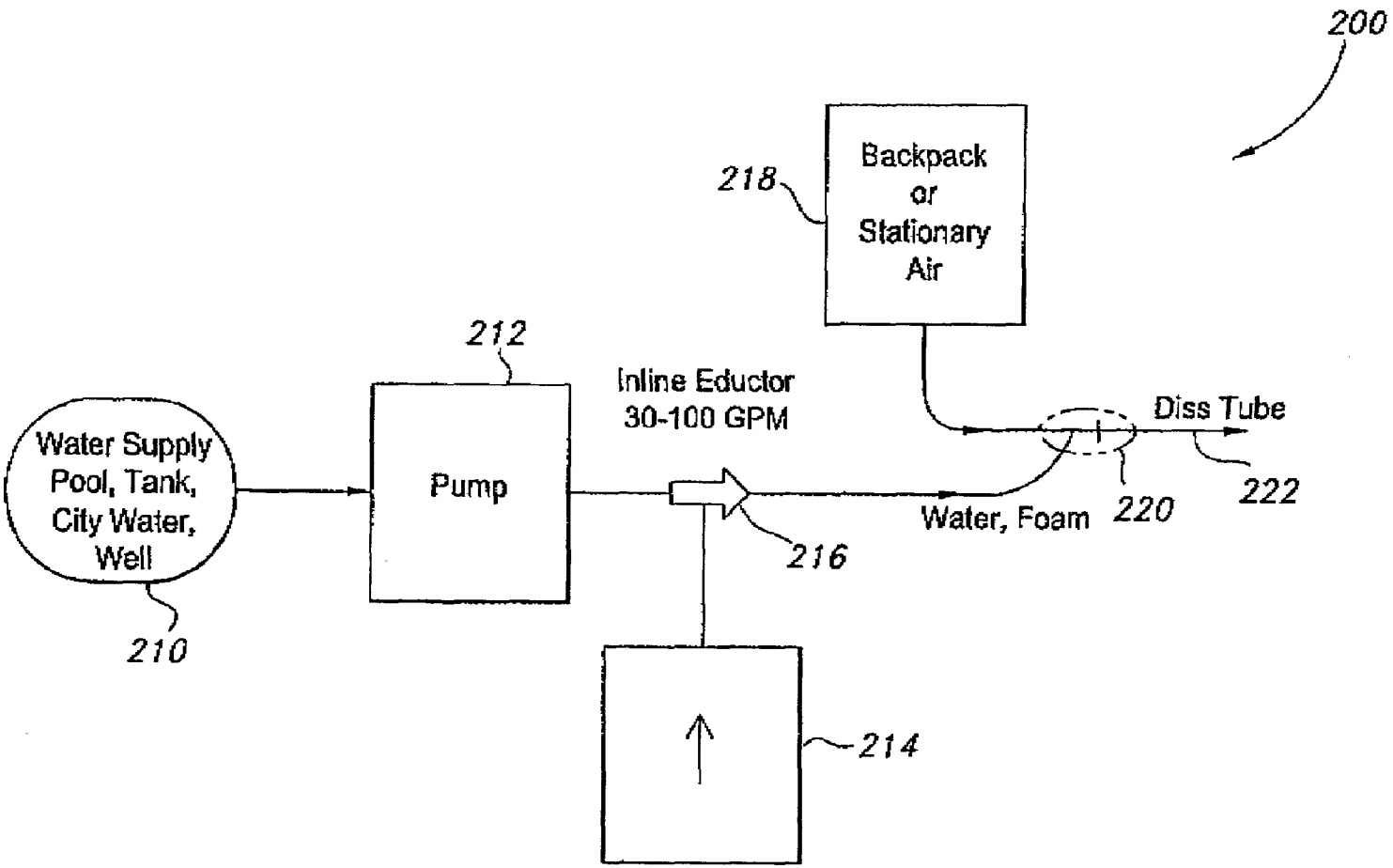
FIG. 6 is a diagrammatic view of an exemplary foam generation system according to the present disclosure, wherein the system pumps water from a water source and discharges high volume, low pressure foam to or toward a desired target.

With reference to the schematic illustration of FIG. 6, a further foam generation system 200 according to the present disclosure is provided. Thus, according to exemplary foam generation system 200, water is pumped by pump 212 from a water source 210 that is available on location, e.g., a pool, tank, city water supply, hydrant, well, standpipe or the like. An inline eductor is positioned in the flow line from pump 212 to mixing unit/nozzle 220. A foam source 214, e.g., a foam can or jar, is used to supply foam to eductor 216. Water flow through eductor is generally 30 to 100 gpm.

Air flow to mixing unit/nozzle 220 is effected by a blower/compressor 218, e.g., a back pack blower or stationary/wheel-mounted blower. The design and operation of mixing unit/nozzle 220 corresponds to the design and operation of mixing unit/nozzle 10 discussed above. Thus, mixing unit/nozzle 220 is effective in aerating the water/foam stream fed thereto, and delivers large volumes of foam to or toward a desired target through discharge outlet 222.

Figure 7:
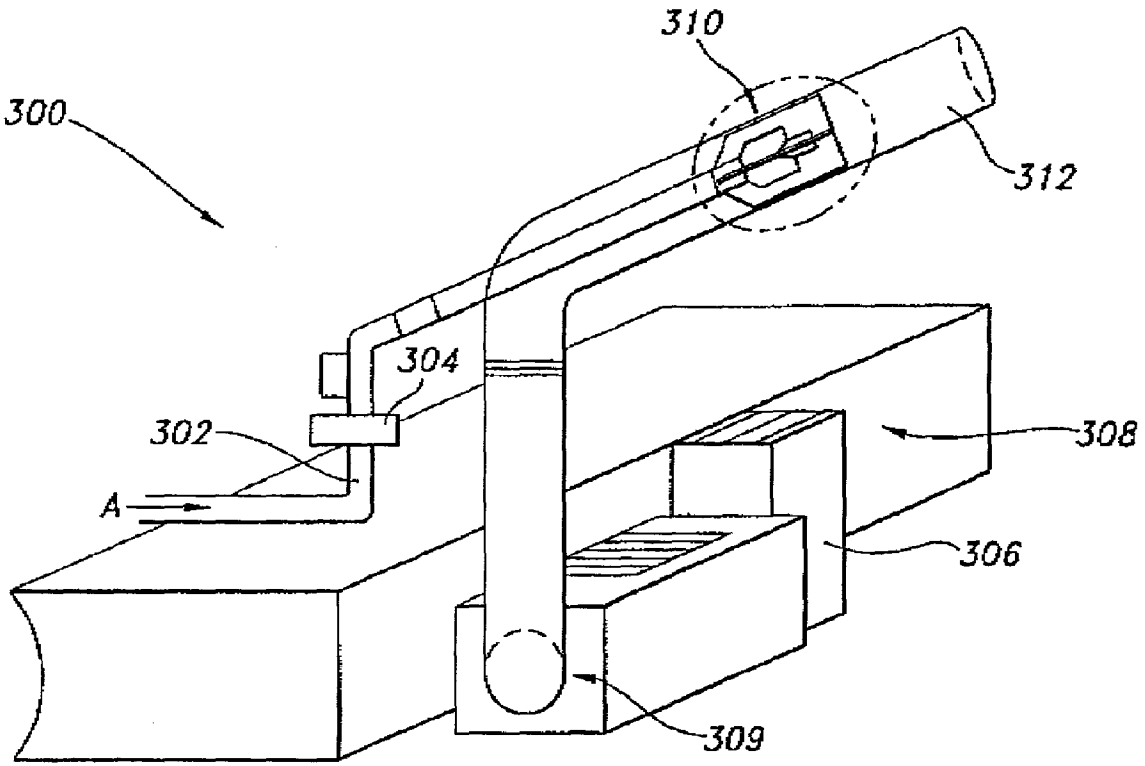
FIG. 7 is perspective view of an exemplary foam generation system according to the present disclosure, the foam generation system being mounted in part to a bumper of a vehicle.

Turning to FIG. 7, a further exemplary foam generation system 300 according to the present disclosure is depicted. Foam generation system 300 draws on a source of water and foam that is pumped through feed line 302 in the direction of arrow "A", e.g., from a storage tank (not pictured) positioned on a fire truck. A valve 304 is positioned in feed line 302 to facilitate flow regulation from the storage tank. A source of pressurized air is also provided as part of foam generation system 300. In particular, a blower 306 is mounted to a bumper 308 of a conventional fire truck. Blower 306 of foam generation system 300 need not be mounted to bumper 308, but could achieve the purpose of firetruck mobility through mounting to or positioning on any structure associated with the firetruck, e.g., the deck.

According to an exemplary embodiment of the present disclosure, blower 306 is a 10-horsepower gas blower that is rated for 2500 cfm. Air discharge from blower 306 is piped to mixing unit/nozzle 310 by way of hose 309. According to an exemplary embodiment of the present disclosure, hose 309 is a large diameter DISS (Diameter-Index Safety System) hose that routes the air flow into alignment with the water/foam flow from feed line 302, e.g., through a pair of 90° bends. The design and operation of mixing unit/nozzle 310 corresponds to the design and operation of mixing unit/nozzle 10 described above. However, the scale of mixing unit/nozzle 310 may be increased, based on the overall sizing of the feed streams and pump/blower capacities associated with foam generation system 300 and the fact that the operative components of foam generation system are substantially supported by the firetruck. Thus, mixing unit/nozzle 310 discharges large volumes of foam through discharge tube 312, which may be directed to or toward a desired target. Indeed, foam generation system is capable of processing 100 to 2000 gpm of water/foam mixture to generate and discharge 1500 to 30,000 gpm of Class A or Class B foam.

In a further exemplary embodiment of the present disclosure, a nozzle system has been developed to afford further increased air and water flow capabilities. In this exemplary nozzle design, water/foam flow rates in the 60–200 gpm range are accommodated, and air flows from 650–1250 CFM may be advantageously employed. This exemplary nozzle system is particularly targeted at structural, vehicular, and marine fire fighting efforts which require higher air and water/foam flows, e.g., when compared to wildland fire suppression and/or protection uses.

The disclosed nozzle is a two (2) piece nozzle design with the following parts: (i) a base casting which includes (a) a two (2) layer or compartmented design, i.e., the inner tube supplies air from a blower (back pack, stationary, or portable style), and (b) a discharge end of the nozzle that contains an outside tube over the inner tube. The area between the tubes holds and transfers the water/foam solution through a series of nozzle jets. The jets are replaceable for different gpm flows. The jets are installed at an angle to allow the discharge of water/foam through all the jets to a precise center area ahead of the air tube discharge. The impact of the individual jets upon the other jet's discharge causes an immediate mix of all the water and foam. Because there is no diffuser needed and no water delivery tube in the air flow tube, an improved air flow is obtained along with much higher gpm flow of liquids. A slide-on tube locks onto the base assembly. The slide-on tube is sized to match the discharge gpm and low rate of air. A control valve and pressure gauge are installed at the rear of the outer tube for control of the water foam and the pressure gauge allows a reference to the liquid pressure. This nozzle uses the same high volume, low pressure blower technology to produce compressed air foam also know as CAFS.

Figure 8:
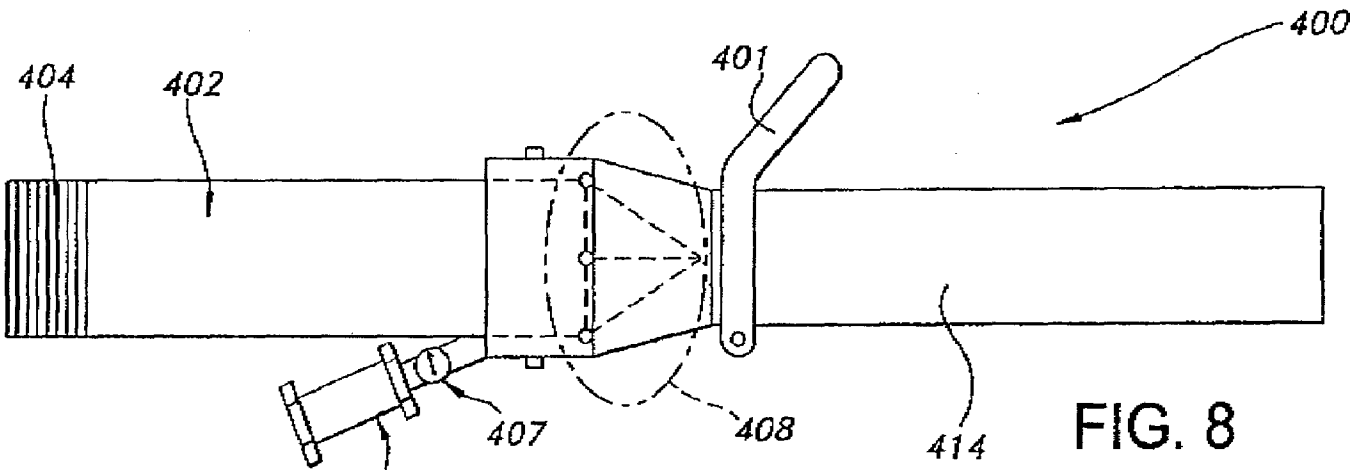
FIG. 8 is a side view of an exemplary foam generation system according to the present disclosure.
Figure 9:
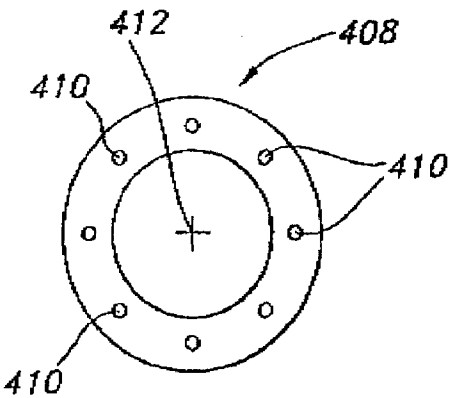
FIG. 9 is a cross-sectional view of a portion of the foam generation system of FIG. 8, taken along line 9—9 therein.

Thus, with reference to FIGS. 8 and 9, a further exemplary nozzle 400 according to the present disclosure (as discussed in the preceding paragraphs) is depicted. Nozzle 400 includes a handle 401 and an unobstructed air feed line 402 which supplies air from an air source, e.g., a blower or compressor. The air feed line includes ribs 404 to facilitate attachment thereof to a hose or other supply line from the air source. A water/foam feed line 406 is provided that includes a pressure gauge 407. Water/foam feed line is of lesser diameter relative to air feed line 402 and runs alongside air feed line 402, but does not enter air feed line 402 in the same manner as previous exemplary embodiments. Rather, water/foam feed line 406 directs water/foam into a series of circumferentially spaced nozzle jets 410 that are coaxially aligned with the direction of air flow through central aperture 412 of diffuser 408.

The individual nozzle jets 410 may be replaced (individually or collectively) if it is desired to change the flow properties of diffuser 408. For example, if it is desired to increase the flow rate through nozzle 400, larger nozzle jets 410 may be introduced to diffuser 408. As the water/foam passes through jets 410 and is directed toward the centerline of nozzle 400, substantial dispersion and mixing are effected. Thus, as the air flow passes through central aperture 412 of diffuser, aeration is achieved, and large volumes of foam are generated.

The disclosed system and method for generating high volume, low pressure foam thus provides a cost effective and enhanced approach to foam generation because, at least in part, the pump only has to pump water and injected foam without having to overcome large friction losses in a fire hose. Water and foam can be easily pumped at pressures up to 400–500 psi.

In a first exemplary mixing unit/nozzle system according to the present disclosure, constructed in accordance with the design of FIGS. 2–4, a 60 gpm nozzle insert is operated in conjunction with a conventional 855 cfm back pack blower. Each gpm of water/foam is aspirated with over 14 cfm of air. The advantageous properties of the generated foam and the expansion of the water foam solution is readily apparent. The foam generated according to the present disclosure possesses more air bubbles in many different sizes and the overall degree of expansion is much improved, thereby contributing to improved performance of the foam itself.

The distance of foam discharge is also improved according to the present disclosure, even though the air is injected at relatively low pressure. Thus, according to exemplary embodiments of the present disclosure, the high volume, low pressure foam exhibits enhanced air flow (650 cfm when fed to a typical 855 nozzle insert vs. 150 to 200 cfm in conventional systems); discharge velocity (typically 200–215 mph in the disclosed system), and foam weight (which is increased relative to prior art systems based on increased volume).

In one exemplary application of the disclosed system, a foam generation and discharge unit may be provided for fire suppression and protection for a "home owner do-it-yourself system," i.e., a system that is not limited to professional fire fighting personnel. The water supply may be sourced from lakes, rivers, pools, wells, storage tanks, etc. A small draft-capable pump is supplied with suction hose for association with the water source. In addition, a small foam eductor may be used for injection of Class A foam or other fire protection liquids.

According to the disclosed do-it-yourself system, the liquid is pumped into a hose that delivers the foam/water solution to a mixing unit/nozzle system and back pack assembly. The user could use the foam generation system for a variety of fire fighting applications, including covering his/her home or any type of structure/item and surrounding land area with a barrier of high volume, low pressure foam for protection against an on-coming fire. A nozzle may be provided that would function effectively in low flow applications for "do-it-yourself" users, e.g., from 20 gpm on up, as will be apparent to persons skilled in the art.

In a further advantageous application of the disclosed foam generation technology, a vehicle mounted nozzle system may be advantageously employed. In such applications, the system design is generally scaled to accommodate very large discharge volumes of high volume, low pressure foam. Thus, a separate blower may be advantageously driven by a separate internal combustion engine or by other power supply systems, e.g., hydraulic, electric, pneumatic, or mechanical power generation/transmission systems. The blower supplies air at a high rate. Typical air flow in vehicle-mounted systems may advantageously range between 2500 to 5000 cfm.

The disclosed foam technology may be advantageously employed with nozzles that are designed to attach to many different existing monitor nozzles, which are also known in the fire service as deck guns. Flows of up to 2000 gpm are available for water/foam streams, and air may be introduced to the mixing unit/nozzle system at rates between 2500 to 5000 cfm.

The disclosed systems and methods for generating and delivering high volume, low pressure foam have numerous advantageous applications. Thus, the disclosed systems and methods perform favorably across a range of operating parameters and equipment/apparatus embodiments, e.g., from the low end 1' hose 60 gpm–400 psi system to a vehicle mounted system as follows. Illustrative applications include the following:

- 250 gpm of aerated foam delivered through a permanently mounted deck gun on a fire apparatus.
- 250 gpm at 125 psi with a ⅞" nozzle and 125 psi of foam pressure with a 2500 cfm low pressure blower super aspirating the water/foam mix will result in a 10 to 1 ratio of air to water/foam mixture, which is the same ratio as the smaller portable system disclosed herein.
- If a large truck with 1000 gallons of water and 5 gallons of Class A foam is used, 15,000 gallons of water/foam mixture will be produced.

Since the advantageous high volume, low pressure foam generation technology of the present disclosure introduces air at the nozzle and not in the pump area, hose lengths are not a problem with friction loss as compared to conventional 200 psi air systems. Increased safety and lower cost are achieved due to a less complex system, thereby lowering potential maintenance costs and reducing training requirements. In addition, the disclosed foam generation technology generally accommodates a wider range of potential foam mixes.

The foam generated according to the disclosed systems and methods is also of superior quality. More air is aspirated using the disclosed high volume, low pressure foam generation technology, which produces more and bigger air bubbles due to the availability of more air. Air bubbles which are made of water foam can absorb more heat, take up more room and exclude $O_2$ faster. Mixed in with the larger bubbles are smaller bubbles which will last a long time, e.g., on a fire scene, and as the bubbles break down with heat and time, more water is advantageously deposited on the grounds.

Use of the disclosed nozzle systems and associated units have significant control and flexibility in using the disclosed foam generation technology. For example, the operator of the disclosed nozzle system can adjust the amount of air or water right at the nozzle, directly controlling the wetness or dryness of the discharged water/foam mixture. Foam generation can thus be adjusted over a wider range by a single person, allowing that individual to select from a very dry foam, which is excellent for protecting exposures, to a very wet foam, which is generally used in actual fire suppression, to foams therebetween. A wide range of feedstock materials may be employed, including both Class A and B foams, to successfully generate and discharge desired aerated foams according to the present disclosure.

As noted above, the disclosed foam generation technology can be readily utilized in a wide range of applications, beyond fire fighting applications, including:

Controlling and killing dangerous insects, such as the South American killer bees, from a long range with very little foam and water.

Biological and chemical suppressing foam can be generated and delivered through the disclosed system for high expansion use in filling buildings, cars, etc.

Agricultural use to discharge water and agents on crops, where the air flow into the nozzle system will help deliver and expand the chemicals to be applied to the crops.

In maintenance applications as a high powered water/foam discharge agent for the purpose of washing surfaces, sidewalks, etc.

While the present invention has been illustrated and described as embodied in various exemplary embodiments, e.g., embodiments having particular utility in fire fighting applications, it is to be understood that the present invention is not limited to the details shown herein, since it will be understood that various omissions, modifications, substitutions and changes in the forms and details of the disclosed systems and methods and their operation may be made by those skilled in the art without departing in any way from the spirit and scope of the present invention. For example, those of ordinary skill in the art will readily adapt the present disclosure for various other applications without departing from the spirit or scope of the present invention.

What is claimed is:

1. An apparatus for generating foam, comprising:

(a) a diffuser unit;

(b) a housing defining a central axis and having a proximal end, a distal end and an internal chamber within which is positioned the diffuser unit;

(c) a first conduit in communication with the proximal end of the housing for supplying a gaseous stream to the diffuser unit;

(d) a second conduit in communication with the proximial end of the housing for supplying a water and foam mixture to the diffuser unit; and (e) an outlet located at the distal end of the housing for expelling an aerated water and foam mixture from the housing;

wherein said diffuser unit includes a conically shaped dispersing element aligned with the central axis of said housing;

wherein the water and foam mixture supplied to said diffuser unit flows on a flow axis aligned with the central axis of the housing, and wherein the conically shaped element is aligned with the flow axis of the water and foam mixture; and wherein the diffuser unit transforms the water and foam mixture supplied to the diffusing unit to a thin film.

2. The apparatus as defined in claim 1, wherein the diffuser unit includes a plurality of axially aligned blade structures that bisect the housing.

3. The apparatus as defined in claim 2, wherein the plurality of axially aligned blade structures includes at least two crisscrossing blades that define an internal void.

4. The apparatus as defined in claim 3, wherein the diffuser unit further comprises a dispersing element positioned within said internal void and aligned with the central axis of the housing.

5. The apparatus as defined in claim 1, further comprising a pressure gauge associated with at least one of the first conduit and the second conduit.

6. The apparatus as defined in claim 1, further comprising a valving mechanism operatively associated with at least one of the first conduit, the second conduit and the outlet.

7. An apparatus for generating foam, comprising:

(a) a diffuser unit;

(b) a housing defining a central axis and having a proximal end, a distal end and an internal chamber within which is positioned the diffuser unit;

(c) a first conduit in communication with the proximial end of the housing for supplying a gaseous stream to the diffuser unit;

(d) a second conduit in communication with the proximial end of the housing for supplying a water and foam mixture to the diffuser unit; and (e) an outlet located at the distal end of the housing for expelling an aerated water and foam mixture from the housing;

wherein the first conduit surrounds the second conduit for a predetermined distance; and wherein the second conduit passes through an outside wall of the first conduit.

* * * * *